US006542127B1

(12) United States Patent
Grossman et al.

(10) Patent No.: US 6,542,127 B1
(45) Date of Patent: Apr. 1, 2003

(54) BOOT FOR ANTENNA ASSEMBLY

(75) Inventors: Vitaly Grossman, West Bloomfield, MI (US); Robert D Cross, Sterling Hts., MI (US); Richard A. Close, Farmington Hills, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/015,450

(22) Filed: Dec. 13, 2001

(51) Int. Cl.[7] ..... H01Q 1/32
(52) U.S. Cl. ..... 343/715; 343/900; 343/711
(58) Field of Search ..... 343/711, 713, 343/715, 882, 900, 906

(56) References Cited

U.S. PATENT DOCUMENTS 4,360,814 A * 11/1982 Wells ..... 343/750
4,625,213 A * 11/1986 Horn ..... 343/715
5,838,281 A * 11/1998 Blaese ..... 343/715
6,366,249 B1 * 4/2002 Jones et al. ..... 343/715

* cited by examiner

*Primary Examiner*—Tan Ho
(74) *Attorney, Agent, or Firm*—Laura C. Hargitt

(57) ABSTRACT

A boot for an antenna assembly is disclosed. The antenna assembly includes an antenna mast having an antenna mast nut attached thereto, a tubular housing extending through an aperture in an automobile body, and a center conductor having a threaded stud attached at one end thereto received by the housing. The antenna mast nut is attached to the threaded stud, and an isolator is disposed between the housing and the center conductor. The boot includes a disk-shaped base member having a cylindrical recess and a first diameter formed from a lower surface thereof and a cylinder-shaped projection extending upwardly from an upper surface of the base member. The projection includes a bore having a second diameter smaller than the first diameter formed therethrough. The base member is operable to seal an upper surface of the isolator, a side surface of the isolator and an outer surface of the housing. The projection is operable to seal an outer surface of the center conductor.

8 Claims, 1 Drawing Sheet

BOOT FOR ANTENNA ASSEMBLY

BACKGROUND OF THE INVENTION

The present invention relates generally to automotive antenna assemblies and installations and, in particular, to a boot for an antenna assembly.

Commercial frequency radio broadcasts began in the 1920s and, as the popularity of broadcast radio increased, automobile manufacturers began to offer radios as optional equipment. Eventually, radios were made a part of many vehicles' standard equipment. Indeed, in the present day it is difficult to purchase an automobile without a radio. Antennas, which are used to receive the radio frequency broadcasts and convey the signals to the radio, are well known.

Prior art automotive fixed antennas are typically part of an antenna assembly including an antenna mast that is mounted in an aperture in a surface of an automobile body. A housing extends through the aperture and receives a center conductor having a threaded stud attached thereto. An antenna mast nut is attached at a lower end of the antenna mast. The antenna mast nut attaches to the threaded stud, electrically connecting the center conductor to the antenna mast and to a coaxial cable that extends to the radio. An isolator, which functions as an insulator for the antenna mast and central conductor and which is typically constructed of polypropylene or similar material, is injection molded between the housing and the antenna mast and center conductor. When the automobile is in motion or at other times such as during automatic car washes, the antenna mast of the prior art antenna assemblies is subjected to extremely high but known side forces. These side forces induce a resultant compression force that is applied to the polypropylene isolator. Eventually, the polypropylene material of the isolator of the prior art antenna assemblies may fatigue, allowing water to penetrate deep into the housing. The water causes corrosion of the coaxial cable connections, resulting in reduced reception and the eventual failure of the antenna. The automobile manufacturer, the owner of the automatic car wash facility, or the consumer must then replace the antenna. Regardless of who bears the cost, replacement is undesirable because an antenna subjected to known forces should not have to be replaced.

It is an object of the invention, therefore, to provide a boot for an antenna assembly that will advantageously absorb compressive forces without failing while simultaneously acting as a gasket for sealing the internal connections of the antenna from exterior air and water leakage.

SUMMARY OF THE INVENTION

The present invention solves the problems with automotive antenna assemblies noted above by providing a boot, preferably constructed of neoprene, rubber, or similar material, as part of an automotive antenna assembly.

The antenna assembly includes an elongated antenna mast that is mounted in an aperture in an upper surface of an automobile body. A preferably zinc, generally tubular die cast housing extends through the aperture above the upper surface of the automobile body and receives a cylindrical center conductor that is connected to a coaxial cable extending from a radio. One end of the center conductor extends upwardly through the housing and includes a threaded stud formed thereon. The antenna mast is attached to the threaded stud of the center conductor by an antenna mast nut. The center conductor is thus electrically connected at one end to the antenna mast and at another end to a coaxial cable that extends to the radio. An isolator, typically constructed of polypropylene or similar electrically nonconductive material, is injection molded between the zinc housing and the antenna mast and center conductor.

The boot includes a generally disk-shaped base portion having a cylindrical projection extending from an upper surface thereof. The boot is preferably constructed of neoprene or other similar material. The base portion includes a cylindrical recess having a first diameter formed in a bottom surface. The projection includes a cylindrical bore extending through an upper surface thereof having a second diameter that is less than the first diameter. The boot is advantageously disposed along an upper surface of the isolator of the prior art. The bore is connected to the recess in the base portion, forming a common cavity through which the center conductor may pass and be held securely in place. The recess in the base portion is preferably formed to have a close interference fit with the outer surface of the housing, while the bore is preferably sized to have a close interference fit with the outer surface of the central conductor. A plurality of ribs preferably extends from an upper portion of the inner surface of the bore and from a lower portion of the inner surface of the recess. The ribs advantageously augment the sealing of the outer surfaces of the central conductor and the housing to which the boot is attached.

In addition, the ribs and the material of the boot aid in sealing the surfaces to prevent water leakage past the center conductor to the coaxial cable connections. By preventing the water leakage the boot of the present invention extends the effective life of the antenna.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
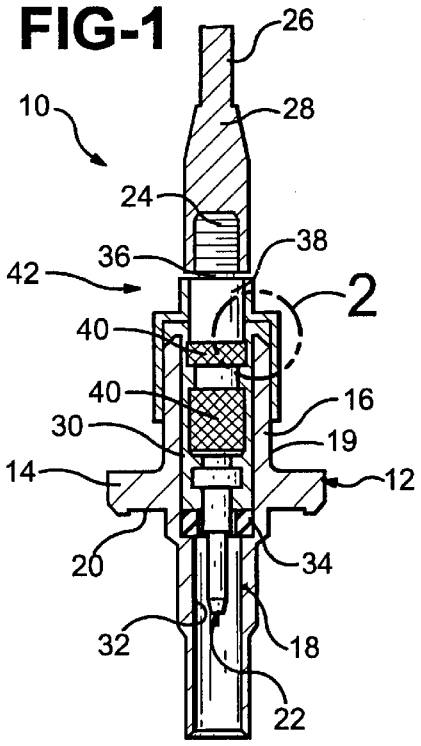
FIG. 1 is cross-sectional view of an antenna assembly including a boot in accordance with the present invention.
Figure 2:
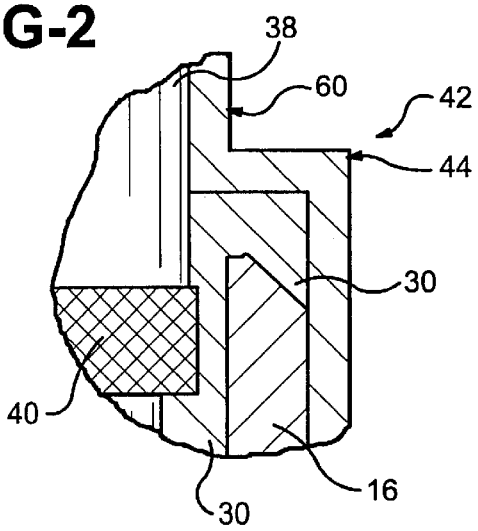
FIG. 2 is an enlarged view on an enlarged scale of the encircled portion 2 of FIG. 1 showing mating surfaces of the antenna assembly and the boot.

Referring now to all of the drawing figures, an antenna assembly is shown generally at 10. The antenna assembly 10 includes a generally tubular housing 12 extending through an aperture (not shown) in a surface (not shown), such as an automobile body. The housing 12 includes a flanged portion 14 having an upper portion 16 and a lower portion 18 extending therefrom. The flanged portion 14 includes a lower surface 20 that is adapted to mate with an upper surface of the automobile body. A plurality of fasteners (not shown) may extend through the flanged portion 14 to affix the housing 12 to the surface. The housing 12 is preferably constructed of die cast zinc or a similar electrically conductive material. The upper portion 16 of the housing 12 extends upwardly beyond the body surface and receives a generally cylindrical center conductor 22.

One end of the center conductor 22 extends upwardly above a top surface of the upper portion 16 of the housing 12 and includes a stud 24 having external threads (not shown) formed thereon. The other end of center conductor 22 extends downwardly below the surface of the automobile body and is connected to a coaxial cable (not shown) extending from the automobile's radio (not shown). An elongated generally cylindrical antenna mast 26 includes an antenna mast nut 28 formed on one end. The antenna mast nut 28 includes internal threads (not shown) for threadably engaging the antenna mast 26 to the threaded stud 24 of the center conductor 22, establishing an electrical connection from the antenna mast 26 to the radio.

An isolator 30, preferably constructed of polypropylene or a similar material is injection molded into the space between the housing 12 and the center conductor 22, forming an insulating layer between the center conductor 22 and an inner surface 32 of the housing 12. A gasket 34 is received by a lower end of the center conductor 22, defining a lower portion of the isolator 30 and sealing a lower portion of the inner surface 32 of lower portion 18 of the housing 12. The center conductor 22 preferably includes a portion 36 adjacent the threaded stud 24 that is of a smaller diameter than the threaded stud 24. A larger diameter portion 38 of the center conductor 22 is adjacent the smaller diameter portion 36 and preferably has a smaller outer diameter than the antenna mast nut 28. The center conductor 22 also preferably includes a plurality of knurled portions 40, one of which is adjacent the large diameter portion 38.

Figure 3:
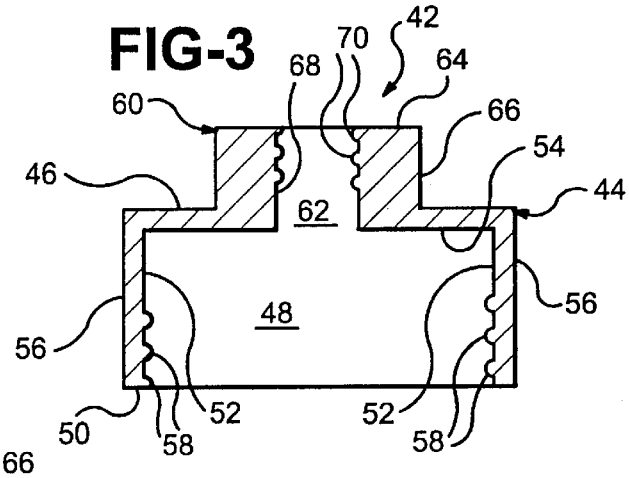
FIG. 3 is a cross-sectional view of the boot shown in FIG. 1.
Figure 4:
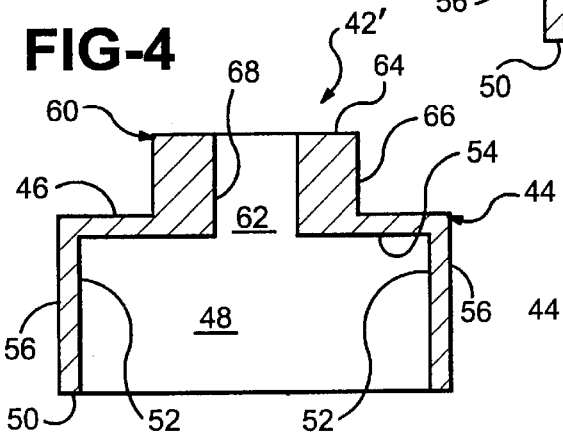
FIG. 4 is a cross-sectional view of an alternative embodiment of a boot in accordance with the present invention.
Figure 5:
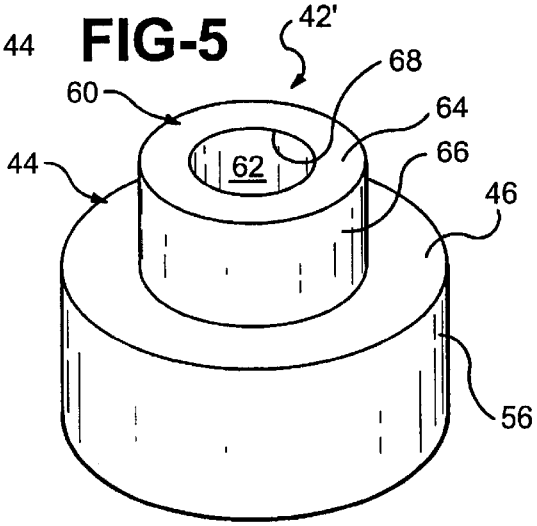
FIG. 5 is a perspective view of the boot of FIG. 4.

A boot according to the present invention is indicated generally at 42. The boot 42 is preferably constructed of neoprene, or a similar material. As best seen in FIG. 3, the boot 42 includes a generally disk-shaped base portion 44 having an upper surface 46 and a cylindrical recess 48 formed from a bottom surface 50. The recess 48 is defined by an interior side surface 52 extending downwardly from an interior upper surface 54. The recess 48 has a diameter that is preferably sized to conform to an outer surface 19 of the housing 12. The base portion 44 includes an exterior side surface 56 extending around the circumference of the base portion 44. A plurality of integral ribs 58 project inwardly from a lower portion of the interior side surface 52 for providing additional sealing between the interior side surface 52 and the exterior outer surface 19 of the housing 12. In an alternative embodiment best seen in the boot 42' of FIGS. 4 and 5, no ribs 58 extend from the interior side surface 52 of the base portion 44.

A generally cylindrical projection 60 extends upwardly from the upper surface 46 of the base portion 44. A generally cylindrical bore 62 extends through an upper surface 64 of the projection 60, the upper exterior surface 46 of the base portion, and an upper interior surface 54 of the base portion. The bore 62 has a diameter that is preferably sized to conform to the outer diameter of the large diameter portion 38 of the center conductor 22. The projection 60 includes an exterior side surface 66 extending around the circumference thereof and an interior side surface 68 extending around the inner diameter thereof, defining the bore 62. A plurality of integral ribs 70 project inwardly from an upper portion of the interior side surface 68 for providing additional sealing between the interior side surface 68 and an exterior surface of the large diameter portion 38 of the center conductor 22. In the alternative embodiment best seen in the boot 42' of FIGS. 4 and 5, no ribs 70 extend from the interior side surface 68 of the bore 62.

After the housing 12 is fastened to the mounting surface, the boot 42 is attached to the housing 12 and center conductor 22. The antenna mast nut 28 is tightened to the threaded stud 24. The interior upper surface 54 of the base portion 44 seals an upper surface of the isolator 30. The interior side surface 52 of the base portion 44 seals a side surface of the isolator and the outer surface 19 of the upper portion 16 of the housing 12. The upper surface 64 of the projection seals a lower surface of the antenna mast nut 28 and an upper surface of the large diameter portion 38 of the center conductor 22. The interior side surface 68 of the projection 60 seals an exterior surface of the large diameter portion 38 of the center conductor 22.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A boot for an antenna assembly, the antenna assembly including an antenna mast having an antenna mast nut attached thereto, a tubular housing, a center conductor received by the housing, the center conductor having a threaded stud attached at one end thereto, the antenna mast nut threadably attached to the threaded stud, and an isolator disposed between the housing and the center conductor, said boot comprising:

a disk-shaped base member having a cylindrical recess formed from a lower surface thereof, the recess having a first diameter; and a cylinder-shaped projection extending upwardly from an upper surface of said base member, said projection having a bore formed therethrough, the bore having a second diameter smaller than the first diameter;

whereby when said boot is installed in the antenna assembly, said base member is operable to seal an upper surface of the isolator, a side surface of the isolator and an outer surface of the housing, and said projection is operable to seal an exterior surface of the center conductor.

2. The boot according to claim 1 including a plurality of ribs projecting inwardly from a lower portion of an interior surface of the recess.

3. The boot according to claim 2 including a plurality of ribs projecting inwardly from an upper portion of an interior surface of the bore.

4. The boot according to claim 1 including a plurality of ribs projecting inwardly from an upper portion of an interior surface of the bore.

5. An antenna assembly for installation on an exterior surface of an automobile body comprising:

a tubular housing for mounting in an aperture in an automobile body, an elongated cylindrical antenna mast member, said mast member operable to receive radio frequency broadcast and having an antenna mast nut attached at one end thereof;

a center conductor received by said housing, said center conductor having a threaded stud attached at one end thereto, said antenna mast nut attached to said threaded stud;

an isolator disposed between said housing and said center conductor;

a boot having a disk-shaped base member having a cylindrical recess formed from a lower surface thereof, the recess having a first diameter, and a cylinder-shaped projection extending upwardly from an upper surface of said base member, said antenna member having a bore formed therethrough, the bore having a second diameter smaller than the first diameter;

wherein said base member is operable to seal an upper surface of said isolator, a side surface of said isolator and an outer surface of said housing; and wherein said projection is operable to seal an exterior surface of said center conductor.

6. The assembly according to claim 5 wherein said boot includes a plurality of ribs projecting inwardly from a lower portion of an interior surface of the recess.

7. The assembly according to claim 6 wherein said boot includes a plurality of ribs projecting inwardly from an upper portion of an interior surface of the bore.

8. The assembly according to claim 5 wherein said boot includes a plurality of ribs projecting inwardly from an upper portion of an interior surface of the bore.

* * * * *